US005169102A

United States Patent [19]

Bracken

[11] Patent Number: 5,169,102

[45] Date of Patent: Dec. 8, 1992

[54] ANNULAR IRON CRADLE

[76] Inventor: Raymond R. Bracken, 1203 Forest Run Dr., Batavia, Ohio 45103

[21] Appl. No.: 811,995

[22] Filed: Dec. 23, 1991

[51] Int. Cl.[5] ..... A47G 29/00

[52] U.S. Cl. ..... 248/117.3; 248/152; 248/176; 211/13; 219/242

[58] Field of Search ..... 748/152, 176, 117.1-117.4; 211/13, 60.1, 70.4, 59.4, 49.1; D23/410; 219/242

[56] References Cited

U.S. PATENT DOCUMENTS

| | | | |
|---|---|---|---|
| 1,700,876 | 2/1929 | Blitz . | |
| 2,494,840 | 1/1950 | Stephenson | 219/242 X |
| 2,550,748 | 5/1951 | Woltz | 219/242 X |
| 3,762,673 | 10/1973 | Koslovsty | 248/154 |
| 3,964,708 | 6/1976 | Reeves | 248/126 |
| 4,159,773 | 7/1979 | Losenno | 211/60 |
| 4,270,660 | 6/1981 | Putt | 211/13 |
| 4,597,551 | 7/1986 | Ciechanowski | 248/314 |
| 5,007,606 | 4/1991 | Allen et al. | 248/152 |

FOREIGN PATENT DOCUMENTS

| | | | |
|---|---|---|---|
| 630015 | 4/1936 | Fed. Rep. of Germany | 405/288 |

*Primary Examiner*—Alvin C. Chin-Shue
*Attorney, Agent, or Firm*—Steven J. Rosen

[57] ABSTRACT

An iron cradle particularly useful for hair curling irons has a curved shell, curved about a centerline, open at its top, and a base that mounts the shell in a horizontal postion so that an iron may be layed down horizontally in the shell. The shell and base are preferably made from two halves of a length of PVC pipe glued back to back having ends that are cut and curved and edges that are smoothed to provide safety and for esthetics.

3 Claims, 1 Drawing Sheet

ANNULAR IRON CRADLE

BACKGROUND OF THE INVENTION

1. Field of the Invention

The invention relates to supports for irons, and particularly for a cradle for an electrically heated curling iron.

2. Description of Related Art

Support devices and holders for electrically heated irons have long been a subject of concern for safety minded users and manufacturers for both commercial and consumer applications. Irons generally have barrel like heating elements attached to body of revolution handles and electrical cords protruding from the back end of the handle. Irons such as soldering and curling irons develop heat in an elongated barrel that, when heated, can burn and both damage people and things such as tabletops. The danger is further increased due to the nature of the handle which is usually also an elongated barrel like body of revolution. An inherent lack of stability is a characteristic of irons relating to their circular cross-sections which permit them to turn or spin easily on a flat surface. They are also easily tipped.

Several devices have been developed to hold or cradle irons such as curling irons. One typical holder is a bent wire support that is rotatably attached to the iron handle for easy deployment as illustrated in U.S. Pat. No. 1,700,876, entitled "Support for Iron", by R. S. Blitz, issued Feb. 5, 1929. However irons employing such wire supports are easily turned around, tipped over, and knocked off tabletops. Another device to hold irons is typified by a base mounted cylindrical holder with means to grasp the handle of the iron in such a way that it will not touch the cylindrical shell of the holder such as that shown in U.S. Pat. No. 3,964,708, entitled "Hair Dryer Cradle", by Michael G. Reeves, issued Jun. 22, 1976. Though such holders are more effective than the wire support they are far more complicated, more costly to produce, and must be mounted to a wall or other surface and as such is not easily transported.

SUMMARY OF THE INVENTION

The present invention provides an iron cradle that has a curved, preferably semi-cylindrical, shell that is continuously curved about a centerline, and a base that mounts the shell in a horizontal position so that the iron may be layed down horizontally in the shell.

One particular embodiment of the present invention provides a base as wide and as long as the shell to enhance its stability. The preferred embodiment provides partially cylindrical shell and base formed from two halves of a portion of pipe, preferably plastic pvc, generally corresponding in length to the length of an iron wherein the ends are cut and curved back, the edges smoothed to provide safe edges and eye appeal, and the halves are glued together back to back.

ADVANTAGES

Among the advantages provided by the present invention is a safe, easy, and simple way to hold and support an iron during use and operation. The present invention is safe, extremely stable, easy and inexpensive to construct, easy to use and store, versatile, able to accommodate many size irons of varying width and length and handle styles, and occupies a relatively small area on a work surface.

BRIEF DESCRIPTION OF THE DRAWING

The foregoing aspects and other features of the invention are explained in the following description, taken in connection with the accompanying drawing where.

DETAILED DESCRIPTION OF THE INVENTION

Figure 1:
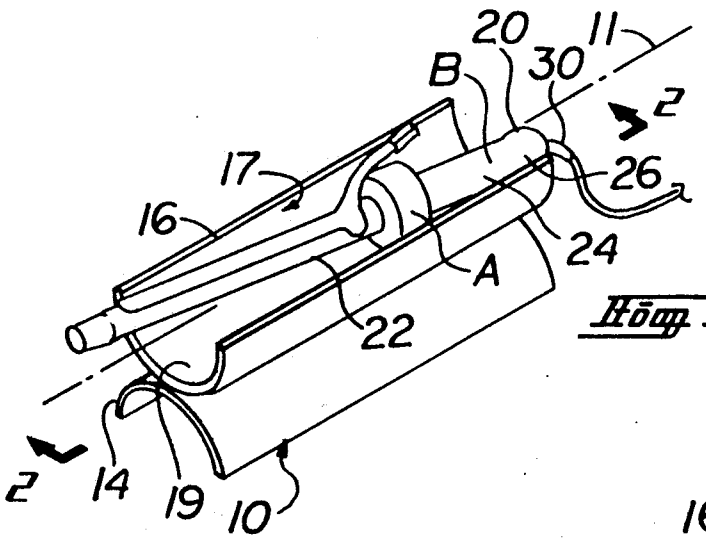
FIG. 1 is a perspective view of an iron cradle in accordance with one embodiment of the present invention.

Illustrated in FIG. 1 is an iron cradle 10 having an inverted curved, preferably half-cylindrical, base 14 and a curved, preferably half-cylindrical, shell 16 curved about a centerline 11. Shell 16 includes an axially extending essentially liner bottom 19. Shell 16 is mounted to base 14 such that the shell 16 is in a horizontal position when base 14 is set on a flat horizontal surface such as a counter or tabletop. An iron 20 is also shown in FIG. 1 to illustrate general relationships between the iron and iron cradle 10. Note that iron barrel 22 is tilted upward due to the general arrangement of iron handle 24 wherein a forward annular section A is larger than the largest annular section B of the grip 26 of handle 24.

Figure 2:
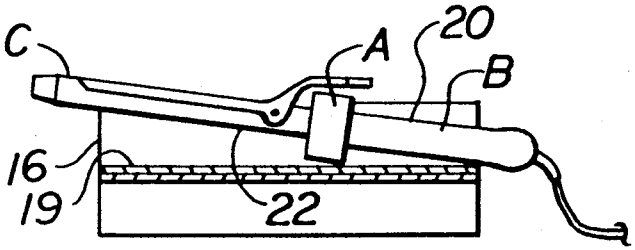
FIG. 2 is an axially extending cross-sectional view through the cradle and iron in FIG. 1.

Briefly referring to FIG. 2, the general relationship of the circumferences of enlarged wide handle section A, a narrow grip section B, and a narrow barrel section C of the iron 20 as they are aligned within shell 14 are shown. This relationship causes iron 20 to tilt its barrel section C upwards in a safe position. As can be seen in FIG. 1, iron 20 may be twisted, turned canted, or slid but it will always tend to fall, slide, or slip back into the circular bottom 19 of shell 16 and its center will always tend to axially align with center line 11 of semi-cylindrical shell 16. Referring back to FIG. 2, barrel 22 is held up by the weight of handle 20 assisted by at least part of the weight of the iron cord 30 pivoted about the enlarged handle section A.

Figure 3:
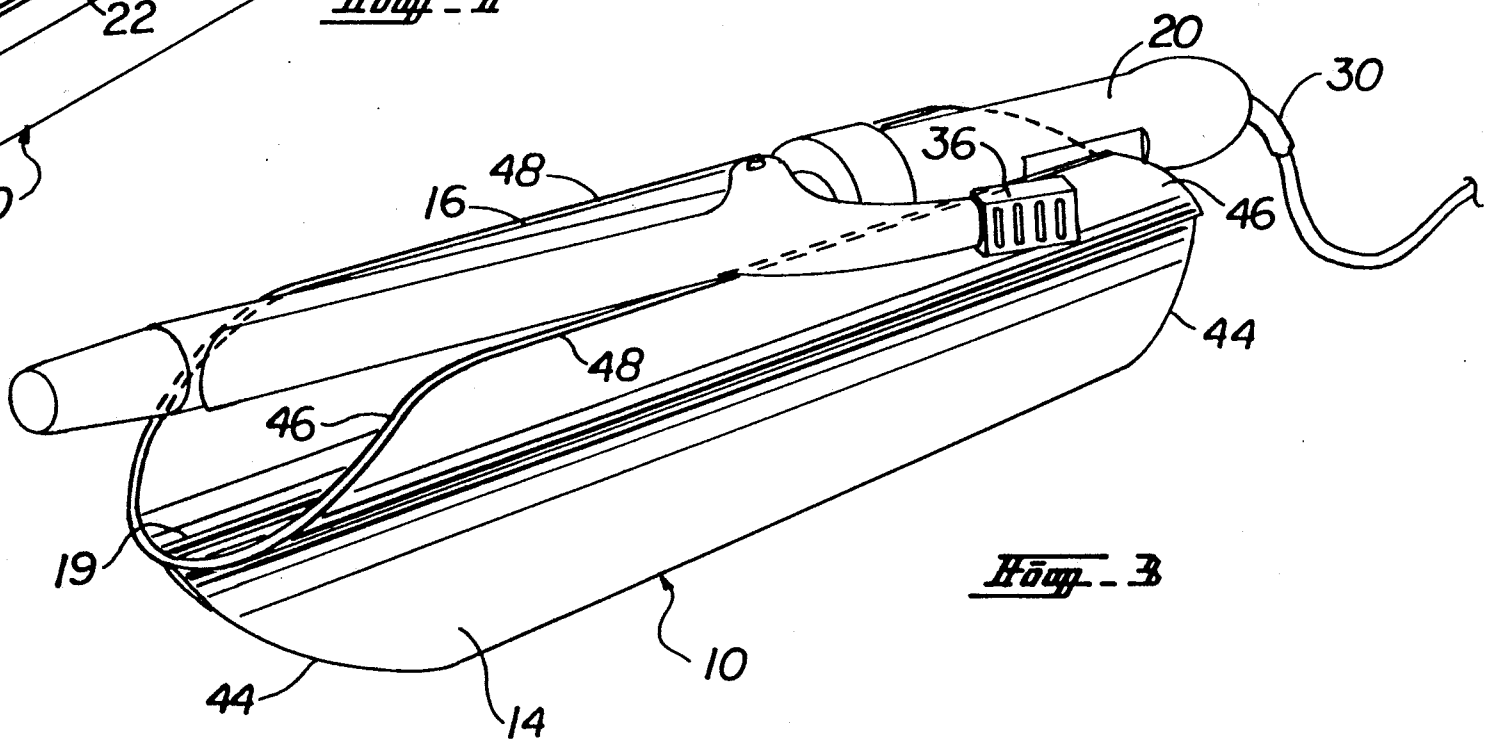
FIG. 3 is a perspective view of a curling iron disposed in an iron cradle in accordance with the preferred embodiment of the present invention.

Shell 16 has an opening 17 at its top that is of sufficient width to allow relatively unrestricted placement of the iron in the shell and for the iron's clip handle 36 if one is provided as shown in FIG. 3 to hang over edge 48 of shell 16. This arrangement places iron 20 in an orientation favorable to the user or operator for easily picking up the iron by its handle 26, particularly when it is hot. Furthermore cradle 10 of the present invention allows the force of gravity to cradle iron 20 in shell 16 against random dislodging forces.

Illustrated in FIG. 3 is the preferred embodiment, having cylindrical shell 16 and base 14 formed from two halves of a portion of pipe, preferably plastic pvc pipe, generally corresponding in length to the length of an iron wherein ends upper 44 and base ends 46 are smoothly cut and curved back, edges 48 are smoothed for safety and esthetics, and the shell and base are glued together back to back.

The iron cradle of the present invention provides extremely stable cradling of the iron because the iron have concentric annular handle sections will always have at least two cross-sections that will slide, due to its weight and the action of gravity, into the lowest surface in the cylindrical shell thereby keeping the hot barrel of the iron away from the shell's walls. The cord 30 will also act to hold the iron in a safe position in the shell and relative movement between the iron or its cord and the shell will result in the iron revolving in the shell but being knocked out of the shell or tipping.

While the preferred embodiment of our invention has been described fully in order to explain its principles, it is understood that various modifications or alterations may be made to the preferred embodiment without departing from the scope of the invention as set forth in the appended claims.

I claim:

1. An iron and cradle assembly comprising:

a curved generally semi-cylindrical shell, said iron received within said shell said iron comprising a barrel attached to an end of a body of revolution handle, said shell open at its top and curved about a centerline, a continuously curved generally semi-cylindrical base effective to support said shell on a table top like surface, said base coextensive with and mounted to said shell for supporting said shell in a horizontal position, and said shell has an underside mounted back to back with said base.

2. An iron and cradle assembly as claimed in claim 1 wherein said curved shell and said base are formed from two halves of cylindrical pipe.

3. An iron and cradle assembly as claimed in claim 2 wherein said pipe is plastic PVC and said shell and base are glued back to back.

* * * * *